US009170063B2

(12) United States Patent
Krieger

(10) Patent No.: US 9,170,063 B2
(45) Date of Patent: Oct. 27, 2015

(54) FIREARM TRIGGER ASSEMBLY

(76) Inventor: John M. Krieger, Hartford, WI (US)

( * ) Notice: Subject to any disclaimer, the term of this patent is extended or adjusted under 35 U.S.C. 154(b) by 638 days.

(21) Appl. No.: 13/106,401

(22) Filed: May 12, 2011

(65) Prior Publication Data

US 2011/0277367 A1 Nov. 17, 2011

Related U.S. Application Data

(60) Provisional application No. 61/395,358, filed on May 12, 2010.

(51) Int. Cl.
*F41A 19/10* (2006.01)
*F41A 19/16* (2006.01)

(52) U.S. Cl.
CPC ..... *F41A 19/10* (2013.01); *F41A 19/16* (2013.01); *Y10T 29/49826* (2015.01)

(58) Field of Classification Search
CPC ..... F41A 19/10; F41A 19/15; F41A 19/09
USPC ..... 42/70.04, 69.01; 89/136
See application file for complete search history.

(56) References Cited

U.S. PATENT DOCUMENTS

| | | | | |
|---|---|---|---|---|
| 290,737 | A | | 12/1883 | Brown |
| 1,830,212 | A | | 11/1931 | Stiennon |
| 2,126,076 | A | | 8/1938 | Wright et al. |
| 2,249,232 | A | | 7/1941 | Smith |
| 2,584,299 | A | | 2/1952 | Sefried, II |
| 2,618,878 | A | | 11/1952 | Mulno |
| 3,550,301 | A | | 12/1970 | Shesterikov |
| 3,791,061 | A | | 2/1974 | Tirone |
| 3,863,375 | A | | 2/1975 | Browning |
| 3,950,876 | A | | 4/1976 | Wild et al. |
| 4,422,254 | A | | 12/1983 | McQueen |
| 4,463,654 | A | | 8/1984 | Barnes et al. |
| 4,646,457 | A | | 3/1987 | Verney-Carron |
| 4,671,005 | A | | 6/1987 | Jewell |
| 4,730,406 | A | | 3/1988 | Forbes et al. |
| 4,908,970 | A | | 3/1990 | Bell |
| 5,187,312 | A | | 2/1993 | Osborne |
| D364,207 | S | | 11/1995 | Tuomey |
| 5,487,233 | A | * | 1/1996 | Jewell ..... 42/69.01 |
| 5,501,134 | A | | 3/1996 | Milazzo et al. |
| D371,591 | S | | 7/1996 | Lenkarski et al. |
| 5,560,134 | A | | 10/1996 | Van Niekerk et al. |
| D388,149 | S | | 12/1997 | Langner |
| D399,914 | S | | 10/1998 | Walker |
| 5,924,231 | A | | 7/1999 | Kidd |

(Continued)

OTHER PUBLICATIONS

Timney Triggers, Winchester 70 Replacement Trigger, www.timneytriggers.com, printed Jul. 31, 2014.

(Continued)

*Primary Examiner* — Benjamin P Lee
(74) *Attorney, Agent, or Firm* — Ryan Kromholz & Manion, S.C.

(57) ABSTRACT

Provided are systems and methods related to firearm trigger assemblies. An open design trigger assembly is provided to allow easier access to the trigger action. The trigger assembly is preferably an override trigger assembly, which may include adjustable trigger travel limiter and trigger bias force. Methods according to the present invention include a first step of removing either a direct-pull or a closed design trigger assembly from a firearm and replacing such removed assembly with an open design override trigger assembly.

17 Claims, 4 Drawing Sheets

(56) References Cited

U.S. PATENT DOCUMENTS

| | | | | |
|---|---|---|---|---|
| 6,347,474 | B1 | 2/2002 | Wolff, Jr. | |
| D462,105 | S | 8/2002 | Myers | |
| 6,553,706 | B1 | 4/2003 | Gancarz et al. | |
| 6,615,527 | B1 | 9/2003 | Martin | |
| 6,722,072 | B1 * | 4/2004 | McCormick | 42/75.03 |
| 6,772,548 | B1 | 8/2004 | Power | |
| 6,843,013 | B2 | 1/2005 | Cutini et al. | |
| 7,162,824 | B1 * | 1/2007 | McCormick | 42/75.03 |
| 7,188,561 | B1 | 3/2007 | Kelbly | |
| 7,293,385 | B2 | 11/2007 | McCormick | |
| 7,331,136 | B2 | 2/2008 | Geissele | |
| 7,398,723 | B1 * | 7/2008 | Blakley | 89/129.01 |
| 7,421,937 | B1 * | 9/2008 | Gangl | 89/142 |
| 7,430,827 | B1 | 10/2008 | Huber | |
| D585,954 | S | 2/2009 | Bubits | |
| D593,617 | S | 6/2009 | Dochterman | |
| D597,626 | S | 8/2009 | Krieger | |
| 8,099,895 | B2 * | 1/2012 | Farley et al. | 42/69.03 |
| 2006/0086031 | A1 | 4/2006 | Geissele | |
| 2006/0101695 | A1 | 5/2006 | Longueira | |
| 2007/0006510 | A1 * | 1/2007 | McCormick | 42/75.02 |
| 2008/0060245 | A1 | 3/2008 | McCormick | |
| 2009/0183414 | A1 | 7/2009 | Geissele | |
| 2009/0188145 | A1 * | 7/2009 | Fluhr et al. | 42/69.01 |
| 2010/0175291 | A1 * | 7/2010 | Farley et al. | 42/69.01 |
| 2011/0185615 | A1 * | 8/2011 | Gangl | 42/69.01 |
| 2012/0180356 | A1 * | 7/2012 | Bender | 42/69.01 |
| 2012/0227301 | A1 * | 9/2012 | Simmons et al. | 42/69.01 |
| 2013/0174459 | A1 * | 7/2013 | Moretti | 42/69.01 |

OTHER PUBLICATIONS

Jard, Inc., Winchester 70 Trigger Upgrade, www.jardinc.com, printed Jul. 31, 2014.

Eabco.com, Rifle Basix Trigger System—Winchester Model 70, http://eabco.com/winchester-triggers.html, printed Jul. 31, 2014.

* cited by examiner

FIREARM TRIGGER ASSEMBLY

RELATED APPLICATIONS

This application claims the benefit of U.S. Provisional Patent Application Ser. No. 61/395,358, filed 12 May 2010.

BACKGROUND OF THE INVENTION

The present invention relates generally to firearms, but more particularly to systems and methods regarding firearm trigger assemblies.

Generally, consistency and accuracy are understandably important in the art of firearms, especially in the field of competitive marksmanship. Regarding firearm trigger assemblies, inconsistency and inaccuracy may be attributed to at least two factors: friction and foreign particulates.

In the art of firearms, trigger assemblies may generally be coarsely divided into two types: direct-pull and override. Each trigger assembly type includes a sear pin which is adapted to abut a firing pin in the associated firearm. However, the two types of trigger assemblies differ in the way that the sear pin maintains the firing pin in a retracted, pre-firing state. A direct-pull trigger assembly generally includes a sear pin that travels generally in a linear path, which is substantially perpendicular to and intersects the path of travel of the firing pin. The sear pin included in an override trigger assembly, on the other hand, is adapted to rotate away from the firing pin, where such rotation is caused by the force of the firing pin acting on the sear pin. The sear pin may be spring biased towards the firing pin, but when the trigger is pulled, the firing pin force is allowed to overcome the sear pin spring bias force, thus allowing the firing pin to contact the ammunition round placed in the firearm.

As previously mentioned, two factors can contribute to undesirable inaccuracy and inconsistency in firearm trigger assemblies: friction and foreign particulates. Friction is of particular concern in direct-pull trigger assembly configurations. When in a cocked or pre-firing state, the direct-pull sear pin is in direct mechanical, frictional contact with a rear portion of the firing pin. To withdraw the sear pin and allow the firing pin to discharge the ammunition, the surface of the sear pin must be drawn across the surface of the portion of the firing pin, while the portion of the firing pin is biased towards the sear pin by a significant amount of force largely perpendicular to the direction of travel of the sear pin. Such interface creates a point of high frictional contact between the sear pin and the portion of the firing pin. Repeated firing actions begin to wear down both the sear pin and the portion of the firing pin, thereby altering the performance of the trigger assembly over time.

Foreign particulates, such as oil, cleaning solutions, dust and dirt, can also affect accuracy and consistency. In an attempt to shield trigger assemblies from foreign particulates, prior after-market or replacement override trigger assembly designs were provided as closed design, or housed, triggers, some of which include small springs, screws and ball bearings in an effort to provide adequate functionality. The theory of such closed designs is believed to rest on the basis that the moving parts of the trigger assembly should be shielded from dust. However, it has been discovered that, contrary to the conventional wisdom that shielding moving parts from dust should improve functionality, the housing, or closed design, actually impedes functionality over time by allowing foreign particulates to accumulate therein. In turn, the closed design or housed trigger assemblies must be disassembled to be cleaned, such as by removing cover plates. Unfortunately, such disassembly creates the risk that the small springs, screws and ball bearings will be lost or damaged. Additionally, foreign particulates may extend what would otherwise be considered a normal lock time. A lock time is the amount of time that passes from the time the trigger mechanism is actuated until the time the firing pin strikes the primer of the ammunition round. Generally, the shorter the lock time, the better. Normal lock times for, e.g., a bolt action rifle such as the Mauser M98, range from about four to about seven milliseconds, with newer models ranging from 2.5 to about seven milliseconds.

Accordingly, the art of firearm trigger assemblies would be enhanced by systems and methods suited to overcome at least the two mentioned causes of inconsistency and inaccuracy, while maintaining or reducing lock time.

SUMMARY OF THE INVENTION

The present invention provides embodiments of systems and methods related to firearm trigger assemblies, which overcome one or more of the above mentioned drawbacks. In general, trigger assemblies according to the present invention will assist in preventing the accumulation of dust and other particulates within the assembly, and will assist in providing easy cleaning access in the event that any foreign particulates do interfere with operation.

A first embodiment of a trigger assembly according to the present invention provides an override trigger assembly that may be adapted to replace a removed trigger assembly in a firearm. The override trigger assembly is preferably provided in an open design configuration.

A first embodiment of a method according to the present invention comprises the steps of removing a direct pull trigger assembly from a firearm and coupling to the firearm an override trigger assembly, which may be an open design assembly. The firearm may be a bolt action rifle.

A second embodiment of a method according to the present invention comprises the steps of removing a closed design override trigger assembly from a firearm and coupling to the firearm an open design override trigger assembly. The firearm may be a bolt action rifle.

An embodiment of a firearm trigger assembly according to the present invention includes three levers, a first lever, a second lever, and a third lever. The first lever extends between a first lever first end and a first lever second end and includes a second-lever engagement means, which may comprise a notch and may be located closer to the first lever first end than to the first lever second end. The first lever is pivotable about a first lever axis and the first lever is biased in a first rotational direction about the first lever axis, which may be located closer to the first lever second end than to the first lever first end. The second lever extends between a second lever first end and a second lever second end and includes a protrusion, such as a wedge, formed thereon. The second lever is pivotable about a second lever axis and the second lever is biased in a second rotational direction about the second lever axis, which is at least substantially parallel with the first lever axis. The third lever extends between a third lever first end and a third lever second end and including a lower rocker surface and an upper pin surface, wherein the third lever is pivotable about a third lever axis, which is at least substantially parallel to the first lever axis. The levers generally cooperate in such a way to maintain a firearm firing pin in a cocked position. The second-lever engagement means rests in contact with the protrusion to prevent rotation of the second lever opposite the second and the third lever is prevented from rotating in a third rotational direction about the third lever axis by the contact of the lower rocker surface with the second lever.

According to one aspect of an embodiment of a firearm trigger assembly according to the present invention, the first lever axis and the second lever axis may lie in a first plane, and the first lever axis and the third lever axis may lie in a second plane, which may be different from the first plane. The first plane and second plane may be arranged perpendicular to each other.

According to another aspect of an embodiment of a firearm trigger assembly according to the present invention, the assembly may further comprise a support bracket, wherein one or more of the levers are pivotably mounted to the support bracket by a bearing disposed coaxial with the associated lever axis. The support bracket may further comprise a mounting structure to assist in coupling the bracket to a firearm, wherein the mounting structure may comprise a mounting yoke.

According to yet another aspect of an embodiment of a firearm trigger assembly according to the present invention, one or more of the second rotational direction and the third rotational direction is/are eccentric to and opposite of the first rotational direction.

According to still another aspect of an embodiment of a firearm trigger assembly according to the present invention, the first lever may be biased in the first rotational direction about the first lever axis by a spring. Additionally or alternatively, the second lever may be biased in the second rotational direction about the second lever axis by a spring acting on a surface of the second lever located between the second lever axis and the second lever second end.

An embodiment of a method according to the present invention comprises the steps of providing a firearm having a firing pin and a first trigger assembly configured to cooperate with the firing pin to maintain the firing pin in a cocked position, removing the first trigger assembly from the firearm, and installing a second trigger assembly on the firearm. Embodiments of the second trigger assembly are described above and hereafter.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
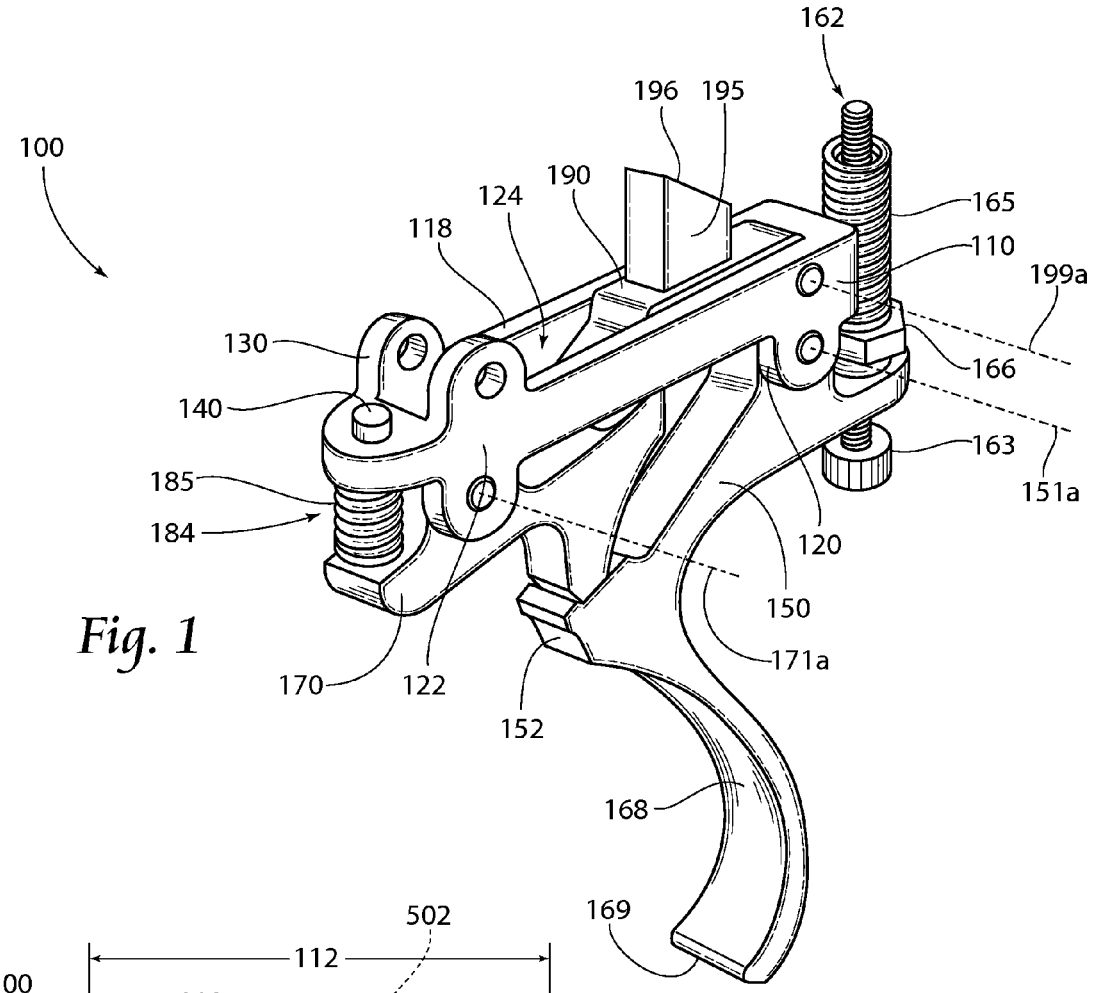
FIG. 1 is a perspective view of an embodiment of a trigger assembly according to the present invention.
Figure 2:
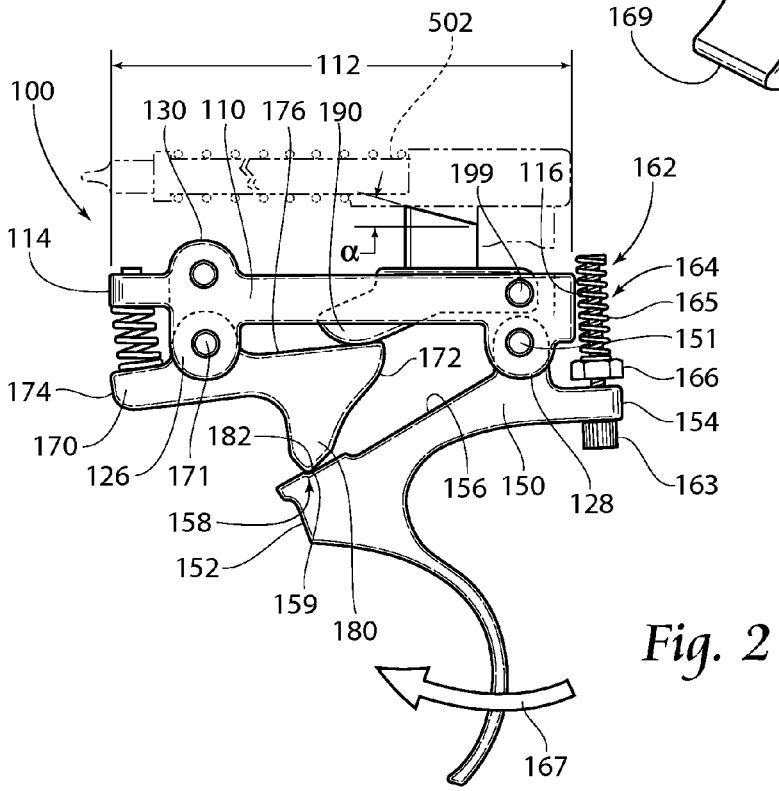
FIG. 2 is a left side elevation view of the embodiment of FIG. 1.
Figure 3:
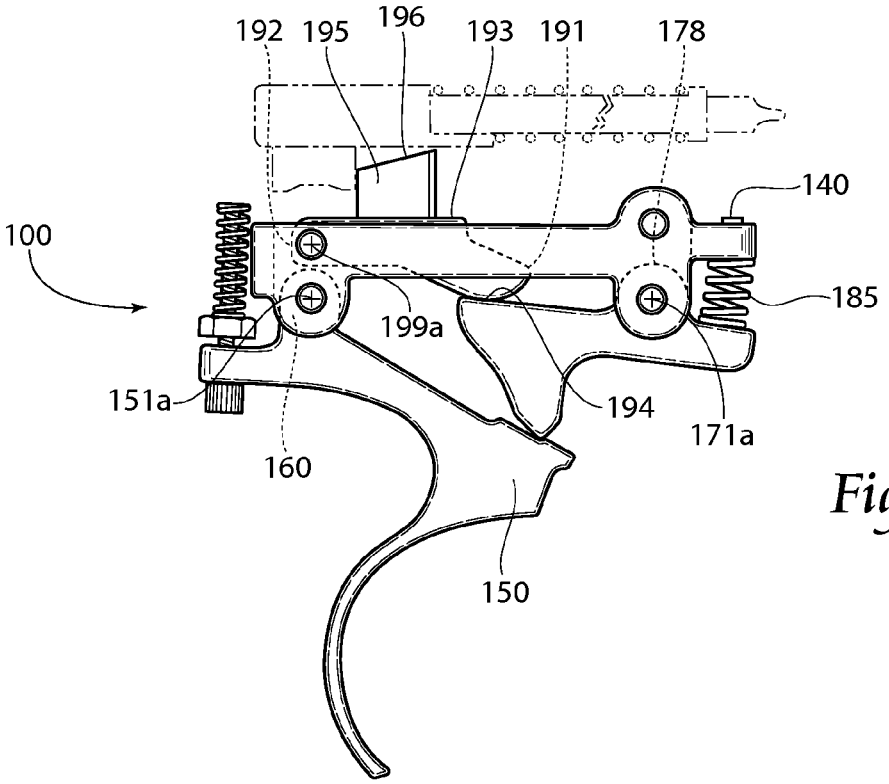
FIG. 3 is a right side elevation view of the embodiment of FIG. 1.

Turning now to the figures, FIGS. 1-3 depict a first embodiment 100 of a trigger assembly according to the present invention. The trigger assembly 100 generally includes a support bracket 110, a trigger lever 150, a transfer lever 170, and a sear lever 190. The support bracket 110 extends longitudinally throughout a bracket length 112 from a first bracket end 114 to a second bracket end 116. The support bracket 110 has a top side 118 and a bottom side 120 coupled together by lateral sides 122, which extend between the first bracket end 114 and the second bracket end 116. Formed along at least a portion of the bracket length 112 and extending through the top side 118 and bottom side 120 is a sear channel 124. Depending downward from and forming a part of the bracket bottom side 120 is a first bearing yoke 126 and a second bearing yoke 128. Extending upward from and forming a part of the bracket top side 118 is a mounting yoke 130. Extending through the bracket top side 118, between the mounting yoke 130 and the first bracket end 114 is a stabilizing screw 140, which is threadably engaged with the mounting bracket 110.

The trigger lever 150 generally extends from a first free end 152 to a second end 154, and includes an upper transfer surface 156 extending therebetween. Disposed on the upper transfer surface 156, closer to the first free end 152 than the second end 154 is at least one transfer lever engagement means 158, such as a notch 159. Extending upward from and forming part of the upper transfer surface 156, closer to the second end 154 than the first free end 152, is a mounting shank 160. Extending from the trigger lever 150, preferably between the mounting shank 160 and the second end 154, is a trigger travel limiter 162, which in one embodiment may be a hex screw 163 extending through and threadably engaged with the trigger lever 150. Also provided is a trigger lever bias means 164, which is preferably a coiled trigger bias spring 165 having a desirable spring constant. The trigger bias spring 165 may be sleeved over the travel limiting screw 163, and may engage a bias adjustment nut 166, which is threadably engaged with the screw 163. Thus, as the nut 166 is threadably adjusted away from the trigger lever 150, the spring 165 is compressed so as to increase the bias force of the trigger lever 150 in a trigger bias direction 167. Extending downward from the trigger lever 150 is a preferably concave trigger engagement surface 168 extending from the trigger lever 150 to a free trigger end 169.

The transfer lever 170 generally extends from a free end 172 to a bias end 174, and includes an upper sear interface surface 176 extending therebetween. The sear interface surface 176 extends generally planarly from the free end 172 towards the bias end 174. The sear interface surface 176 is preferably generally smooth so as to provide a minimal frictional interface between the transfer lever 170 and the sear lever 190. However, extending upward from and forming part of the sear interface surface 176, preferably closer to the second end 174 than the first end 172, is a mounting shank 178. Extending downward from the transfer lever 170, opposite the sear interface surface 176, is a transfer wedge 180, including a distal edge 182, which may be peaked or slightly rounded. Extending from the transfer lever 170, preferably between the mounting shank 178 and the bias end 174, is a transfer lever bias means 184, which is preferably a coiled transfer lever bias spring 185 having a desirable spring constant.

The sear lever 190 generally extends from a free end 191 to a mounting end 192, and includes an upper pin surface 193 and a lower rocker surface 194. Extending upward from the upper pin surface 193 is a sear pin 195. The sear pin 195 is preferably generally a parallelepiped, including a sloped, preferably planar safety surface 196 disposed between a front surface 197 and a rear firing pin engagement surface 198. The safety surface 196 is preferably formed such that when the trigger assembly 100 is in its cocked position, the safety surface 196 is disposed at a desirable angle α with respect to the direction of travel of a firing pin 502. A desirable angle α may be between five and sixty degrees, but a more preferred angle α is between ten and twenty degrees, with about fourteen degrees being most preferred. The lower rocker surface 194 is formed at a desired radius, preferably between about 0.100 inches and about 0.400 inches, with about 0.200 inches being preferred.

Generally, the transfer lever 170 is pivotally mounted to the first bearing yoke 126 by a transfer bearing 171, the trigger lever 150 is pivotally mounted to the second bearing yoke 128 by a trigger bearing 151, and the sear lever 190 is situated at least partially within the sear channel 124 and is pivotally mounted to the support bracket 110 by a sear bearing 199. The bearings 151,171,199 are preferably coaxially disposed with associated lever axes 151*a*,171*a*,199*a* about which each respective lever 150,170,190 is pivotable.

Figure 4:
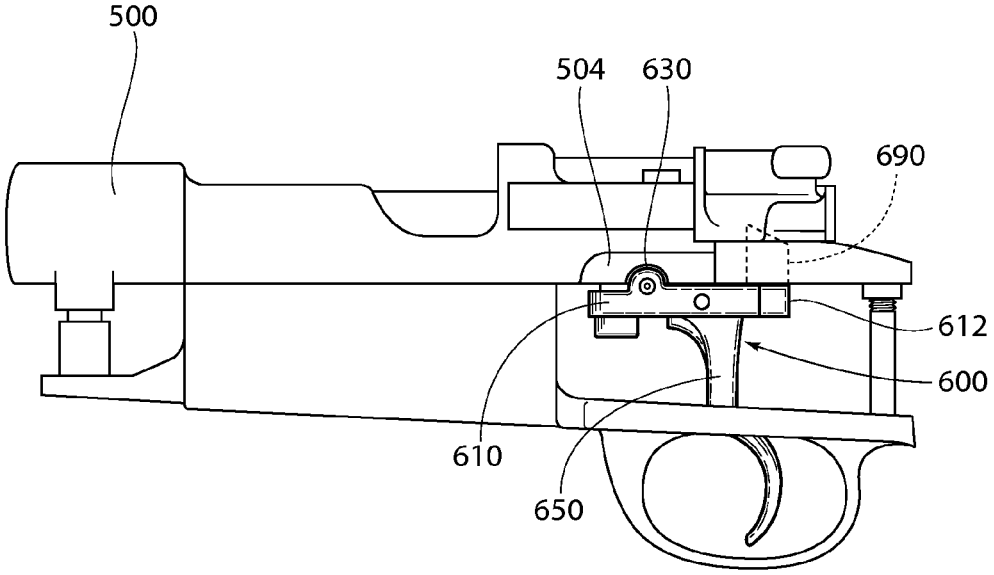
Fig. 4 PRIOR ART
FIG. 4 is a left side elevation view of a prior direct-pull trigger assembly installed in a firearm.
Figure 5:
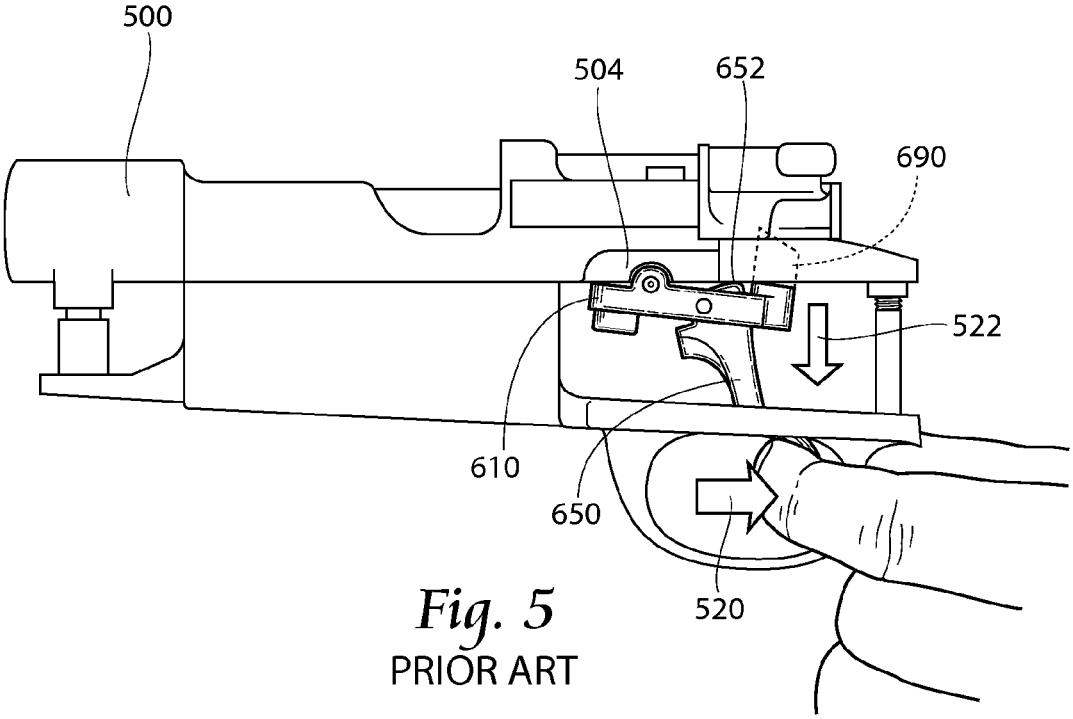
Fig. 5 PRIOR ART
FIG. 5 is a second left side elevation view of the assembly of FIG. 4 in a pulled orientation.

FIGS. 4 and 5 depict a prior art direct pull trigger assembly 600 installed on a firearm action 500. The prior assembly 600 includes a support bracket 610 and a trigger lever 650 pivotally connected thereto. The support bracket 610 includes a mounting yoke 630, which is adapted to be pivotally mounted to the housing 504 of the firearm action 500. Towards a free end 612 of the support bracket 610, and extending upward therefrom, is a sear pin 690, which extends into the firearm action 500 and is adapted to restrain the firing pin (not shown) when the action 500 is in a cocked position. At the top of the trigger lever 650, there is formed a cam surface 652. The cam surface 652 is adapted, when the trigger lever 650 is pulled in a first direction 520, to rock against the housing 504 of the firearm action 500. Such motion forces the support bracket 610, and in turn the sear pin 690, also to move in a second direction 522, which allows the firing pin (not shown) to be released and to strike an ammunition round (not shown) loaded into the firearm action 500. As the sear pin 690 is lowered in the second direction 522, however, the top of the sear pin 690 is actually moving against the bias force of the firing pin (not shown), thereby increasing frictional forces, which may result in decreased performance over time.

Figure 6:
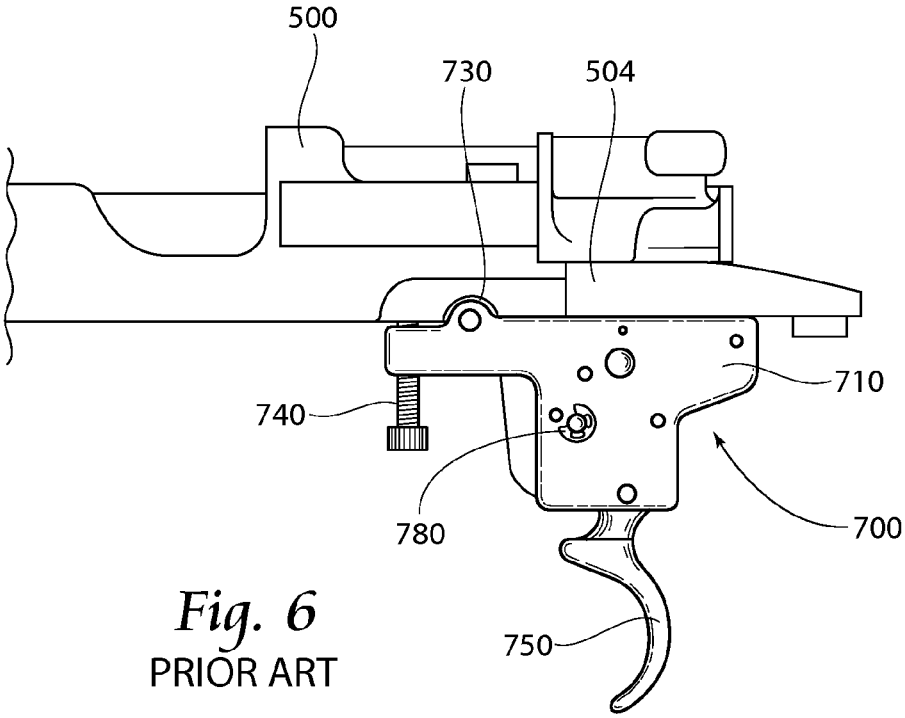
Fig. 6 PRIOR ART
FIG. 6 is a left side elevation view of a prior closed design, or housed, trigger assembly.

FIG. 6 shows a prior art closed design, or housed, override trigger assembly 700 installed on a firearm action 500. The prior assembly 700 includes support plates 710, which obscure and house the override trigger actuation mechanism. Indeed, the entire trigger action of the assembly 700, except of course a trigger lever 750, is obscured. The trigger lever 750 extends from between the plates 710 to allow for actuation. The trigger assembly 700 is mounted to the firearm action 500 by a mounting yoke 730, and held stationary to the action 500 by a threaded stabilizing screw 740. While the housed trigger assembly 700 may be disassembled to be serviced or cleaned, such as by removing, e.g., retaining rings 780, such disassembly is accompanied by the high risk of component damage, loss, or misplacement. Another disadvantage of this design is an increased lock time over prior direct pull triggers. The cause of an increased lock time is thought to be the use of a relatively strong counterbalance spring that is used to decrease wear of the trigger action.

Figure 7:
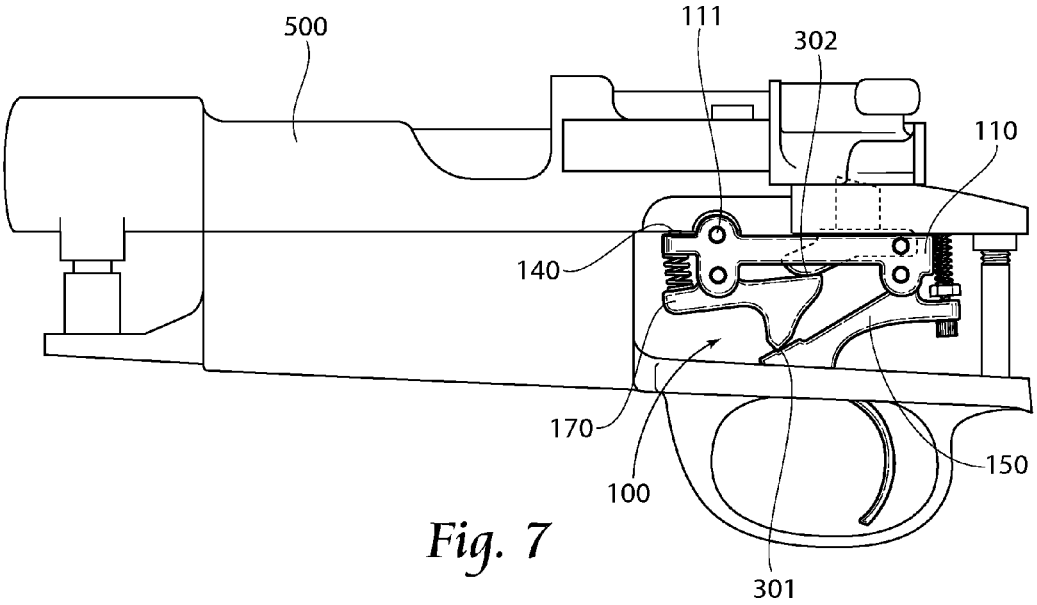
FIG. 7 is a left side elevation view of the embodiment of FIG. 1, in a cocked position, installed on the same firearm depicted in FIG. 4 after the direct-pull trigger was removed.

FIG. 7 shows an embodiment 100 of a trigger assembly according to the present invention installed on a firearm action 500, the trigger assembly 100 shown in a cocked position. After a factory or prior after-market trigger assembly is removed from the firearm as is known, the assembly 100 is installed by coupling the mounting yoke 130 to the firearm action 500 with a mounting pin 111, and securing the assembly in place by tightening the stabilizing screw 140 against the firearm action 500. Thus, a method according to the present invention includes the steps of removing a direct pull trigger assembly, such as the trigger assembly 600 shown in FIG. 5, from a firearm, such as a bolt action rifle, and installing an open design trigger assembly according to the present invention, thereby replacing the removed direct pull trigger assembly. A second method according to the present invention includes the steps of removing a closed design, or housed, override trigger assembly, such as the trigger assembly 700 of FIG. 6, from a firearm, such as a bolt action rifle, and installing an open design trigger assembly according to the present invention, thereby replacing the removed closed design, or housed, override trigger assembly. The method of removal of an extant direct pull or closed design override trigger assembly is generally within the skill of ordinary artisans in the trade.

As can be seen, an open design assembly may provide access to substantially the entire trigger assembly from both lateral sides thereof. Preferably, such access is provided upon simple removal or separation from a firearm without further disassembly. In the depicted three-lever embodiment, there is a first contact point 301 between the transfer lever 170 and the trigger lever 150. There is a second contact point 302 between the transfer lever 170 and the sear lever 190. While the support bracket 110 has been shown manufactured in a way to allow access to both contact points 301,302 in both the cocked and pulled states, it is to be understood that the support bracket 110 may slightly cover one or both points. In this cocked state, the firing pin (not shown) has been automatically or manually retracted to allow the transfer bias means 184 to bias both the transfer lever 170 and the sear lever 190 upwards. The distal edge 182 of the transfer wedge 180 is then nestled into the transfer lever engagement means 158 so as to generally lock the assembly in the cocked position. The firing pin (not shown) is then automatically or manually allowed to rest against the sear pin 190, and the weapon is ready for firing.

Figure 8:
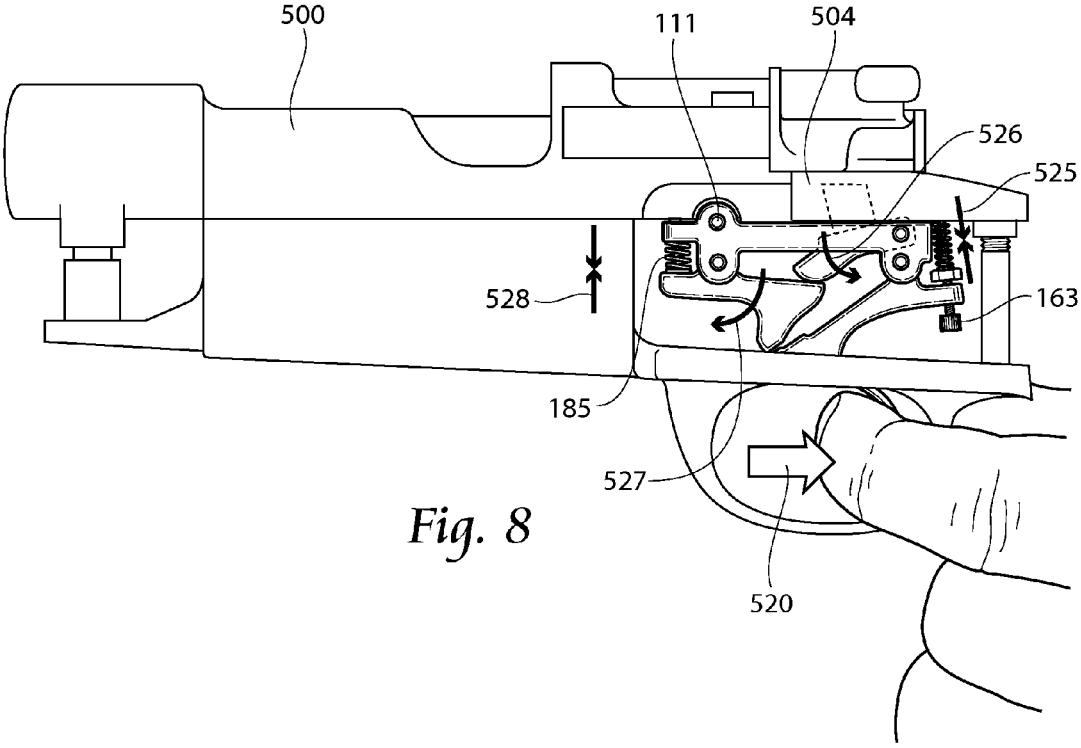
FIG. 8 is the same view as FIG. 7, except that the trigger has been pulled.

FIG. 8 shows the trigger assembly 100 after the pulling of the trigger lever 150 in the first direction 520. The force in such first direction 520 needs to overcome the biasing force of the trigger lever biasing means 164, thus compressing 525 the trigger bias spring 165. The travel of the trigger lever 150, which may be limited by the trigger travel limit screw 163, releases the distal edge 182 of the transfer wedge 180 from the transfer lever engagement means 158. The bias force of the firing pin (not shown) is thus allowed to overcome the retention force supplied to the sear pin 190 by the transfer lever bias spring 185, thus causing the sear lever to rotate in a third direction 526, which in turn causes the transfer lever 170 to rotate in a fourth direction 527, compressing 528 the transfer lever bias spring 185. The trigger assembly 100 may be returned to the cocked position of FIG. 7 by automatically or manually drawing the firing pin rearward to allow the biasing mechanisms 164,184 to bias the sear pin 195 upward to engage a portion of the firing pin.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims. For instance, while the design shown has been adapted and sized to cooperate with an M98 bolt action rifle available from Mauser Jagdwaffen GmbH of Isny, Germany, the general design of the support bracket 110, including the bracket length 112 and mounting yoke 130 can be modified as required to accommodate the mounting mechanism included on other firearms, such as Springfield and Enfield bolt action rifles, onto which an embodiment according to the present invention may be installed. Such modification to the support bracket 110 is considered to be within the skill of the art, including various machining and casting techniques.

I claim:

1. A firearm trigger assembly comprising:

a first lever extending between a first lever first end and a first lever second end and wherein said first lever further includes a second-lever engagement means, wherein the first lever and the second-lever engagement means are pivotable about a first lever axis and the first lever and the second-lever engagement means are biased in a first rotational direction about the first lever axis;

a second lever extending between a second lever first end and a second lever second end and including a protrusion extending therefrom, wherein the second lever is pivotable about a second lever axis and the second lever is biased in a second rotational direction about the second lever axis, and further wherein the second lever axis is at least substantially parallel with the first lever axis; and a third lever extending between a third lever first end and a third lever second end and including a lower rocker surface and an upper pin surface, wherein the third lever is pivotable about a third lever axis, wherein the third lever axis is at least substantially parallel to the first lever axis;

wherein the second-lever engagement means rests in direct contact with the protrusion to prevent rotation of the second lever opposite the second rotational direction, and the third lever is prevented from rotating in a third rotational direction about the third lever axis by the contact of the lower rocker surface with the second lever.

2. A firearm trigger assembly according to claim 1, wherein the first lever axis is located closer to the first lever second end than to the first lever first end.

3. A firearm trigger assembly according to claim 2, wherein the second-lever engagement means is located closer to the first lever first end than to the first lever second end.

4. A firearm trigger assembly according to claim 1, wherein the second-lever engagement means is located closer to the first lever first end than to the first lever second end.

5. A firearm trigger assembly according to claim 1, wherein the second-lever engagement means comprises a notch.

6. A firearm trigger assembly according to claim 1, wherein the protrusion comprises a wedge.

7. A firearm trigger assembly according to claim 1, wherein the first lever axis and the second lever axis lie in a first plane.

8. A firearm trigger assembly according to claim 7, wherein the first lever axis and the third lever axis lie in a second plane, different from the first plane.

9. A firearm trigger assembly according to claim 8, wherein the first plane and the second plane are perpendicular to each other.

10. A firearm trigger assembly according to claim 1, further comprising a support bracket, wherein the first lever is pivotably mounted to the support bracket by a first bearing disposed coaxial with the first lever axis.

11. A firearm trigger assembly according to claim 10, wherein the second lever is pivotably mounted to the support bracket by a second bearing disposed coaxial with the second lever axis.

12. A firearm trigger assembly according to claim 11, wherein the third lever is pivotably mounted to the support bracket by a third bearing disposed coaxial with the third lever axis.

13. A firearm trigger assembly according to claim 10, the support bracket further comprising a mounting yoke.

14. A firearm trigger assembly according to claim 1, wherein the second rotational direction is eccentric to and opposite of the first rotational direction.

15. A firearm trigger assembly according to claim 1, wherein the third rotational direction is eccentric to and opposite of the first rotational direction.

16. A firearm trigger assembly according to claim 1, wherein the first lever is biased in the first rotational direction about the first lever axis by a spring.

17. A firearm trigger assembly according to claim 1, wherein the second lever is biased in the second rotational direction about the second lever axis by a spring acting on a surface of the second lever located between the second lever axis and the second lever second end.

* * * * *